US011974624B2

(12) United States Patent
Kuenzler et al.

(10) Patent No.: US 11,974,624 B2
(45) Date of Patent: May 7, 2024

(54) MASK CLIPS FOR HAT

(71) Applicants: Zane Kuenzler, Littleton, CO (US); Zye J Kuenzler, Littleton, CO (US)

(72) Inventors: Zane Kuenzler, Littleton, CO (US); Zye J Kuenzler, Littleton, CO (US)

( * ) Notice: Subject to any disclaimer, the term of this patent is extended or adjusted under 35 U.S.C. 154(b) by 210 days.

(21) Appl. No.: 17/523,658

(22) Filed: Nov. 10, 2021

(65) Prior Publication Data

US 2022/0142281 A1 May 12, 2022

Related U.S. Application Data

(60) Provisional application No. 63/112,232, filed on Nov. 11, 2020.

(51) Int. Cl.
*A42B 1/24* (2021.01)

(52) U.S. Cl.
CPC ..... *A42B 1/24* (2013.01)

(58) Field of Classification Search
CPC .... A41B 1/24; A41D 13/1161; Y10T 24/1394
See application file for complete search history.

(56) References Cited

U.S. PATENT DOCUMENTS 2,447,996 A * 8/1948 Biagi ..... B42F 1/04 24/336
5,829,103 A * 11/1998 Allen ..... B43K 23/001 24/3.12
7,866,813 B2 * 1/2011 Anhalt ..... A42B 1/247 2/209.13
7,954,943 B2 * 6/2011 Ledford ..... G02C 3/02 24/3.12
8,499,762 B2 * 8/2013 Couts ..... A61M 16/0666 128/200.24
9,161,586 B2 * 10/2015 Brown ..... F21V 21/0885
2012/0272483 A1 * 11/2012 Moore ..... F16B 2/22 24/3.12

* cited by examiner

*Primary Examiner* — Robert Sandy
(74) *Attorney, Agent, or Firm* — Leyendecker & Lemire LLC

(57) ABSTRACT

A mask securing clips for attaching a face mask typically to the rim of a hat, such as a baseball cap, is typically fabricated a single unitary piece that includes a clip portion and a hook portion. The clip portion is generally U-shaped and configured to clip over an edge of a hat's rim typically on the left and right sides of the hat to be securely held thereon. The hook portion is typically formed on the outside surface of the U-shaped clip portion. The hook is configured to receive a loop strap of a face mask.

7 Claims, 8 Drawing Sheets

MASK CLIPS FOR HAT

RELATED APPLICATIONS

This application claims priority to and incorporates fully by reference U.S. Provisional Patent Application entitled Mask Clips for Hat filed on 11 Nov. 2020 and having the same inventor as the present application.

BACKGROUND

In the wake of the Covid-19 pandemic, the wearing of face coverings and particularly face masks have become commonplace and are often mandated by the state and local governments. The most popular style of mask includes loop straps, typically made of an elastic material that loop around the wearer's ears. Overtime, the straps can irritate the back of the ear and cause the wearer significant discomfort. Other means for securing a mask are known, such as upper and lower straps that tie around the back of the head and the neck respectively, but often these alternative securement means are prone to loosening permitting the mask to fall off of the nose and/or mouth.

DETAILED DESCRIPTION OF THE DRAWINGS

DETAILED DESCRIPTION

Figure 1:
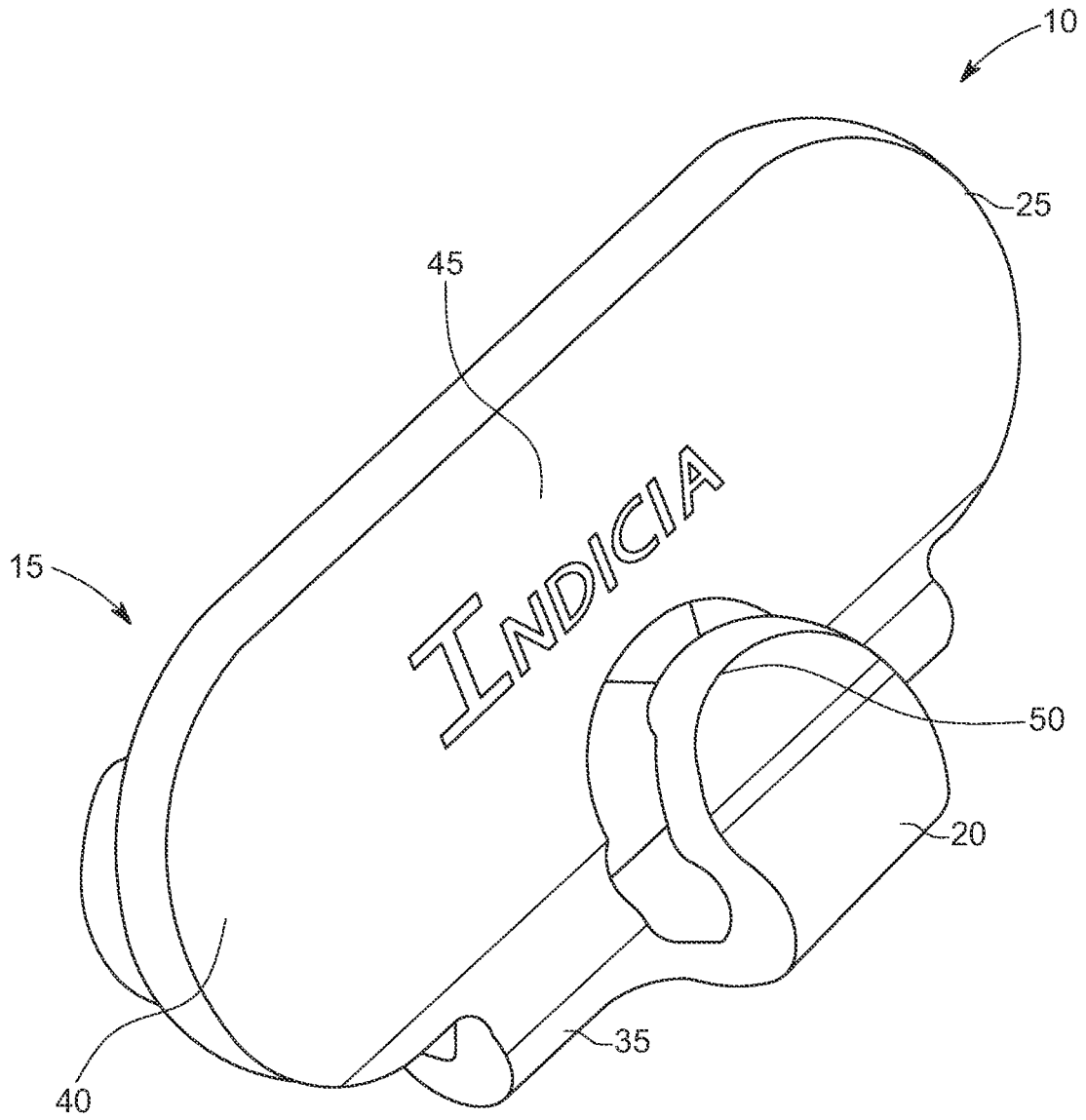
FIG. 1 is a front perspective view of a mask securing clip according to one embodiment of the present invention.
Figure 2:
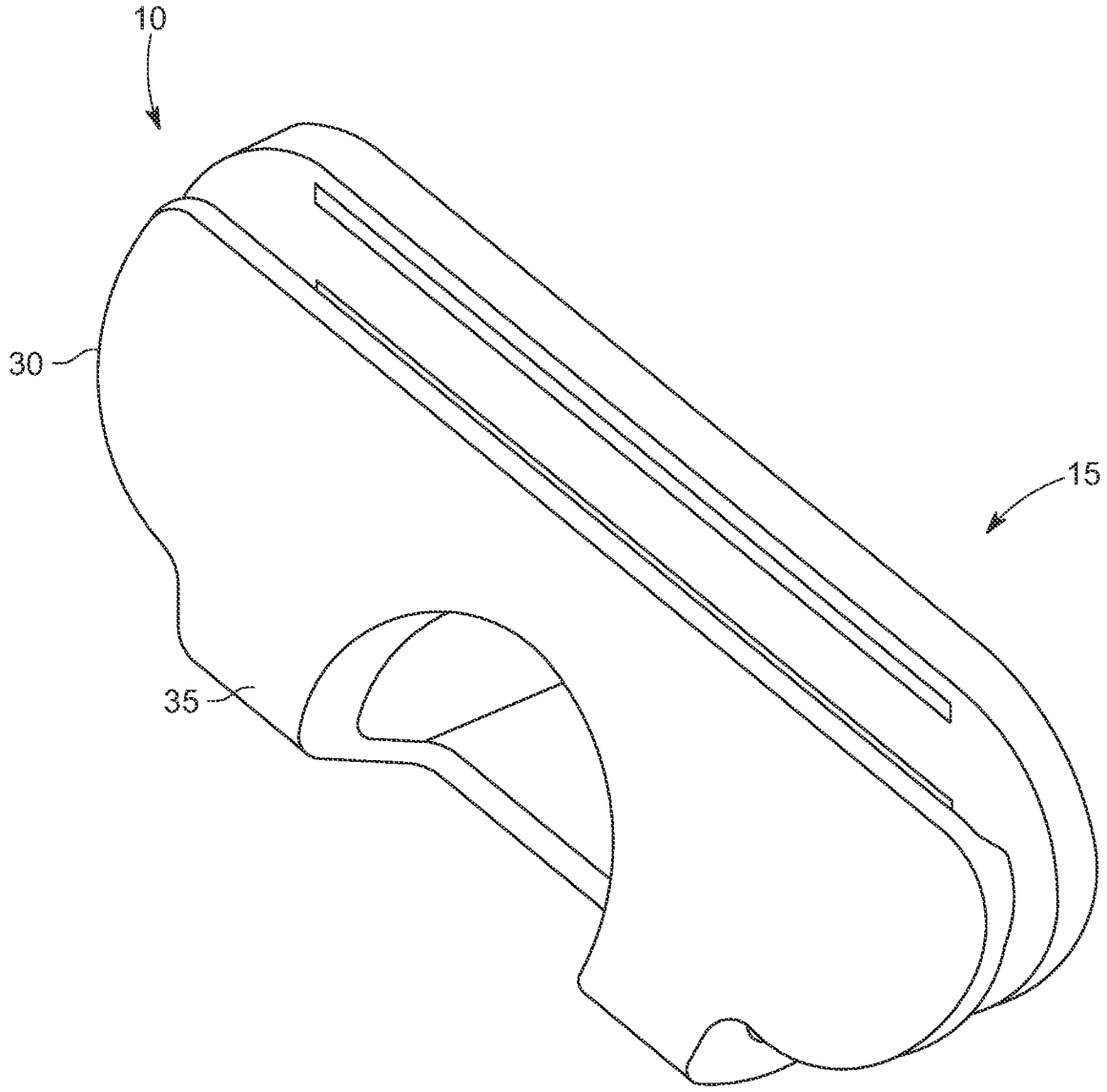
FIG. 2 is a back perspective view of the mask securing clip according to one embodiment of the present invention.
Figure 3:
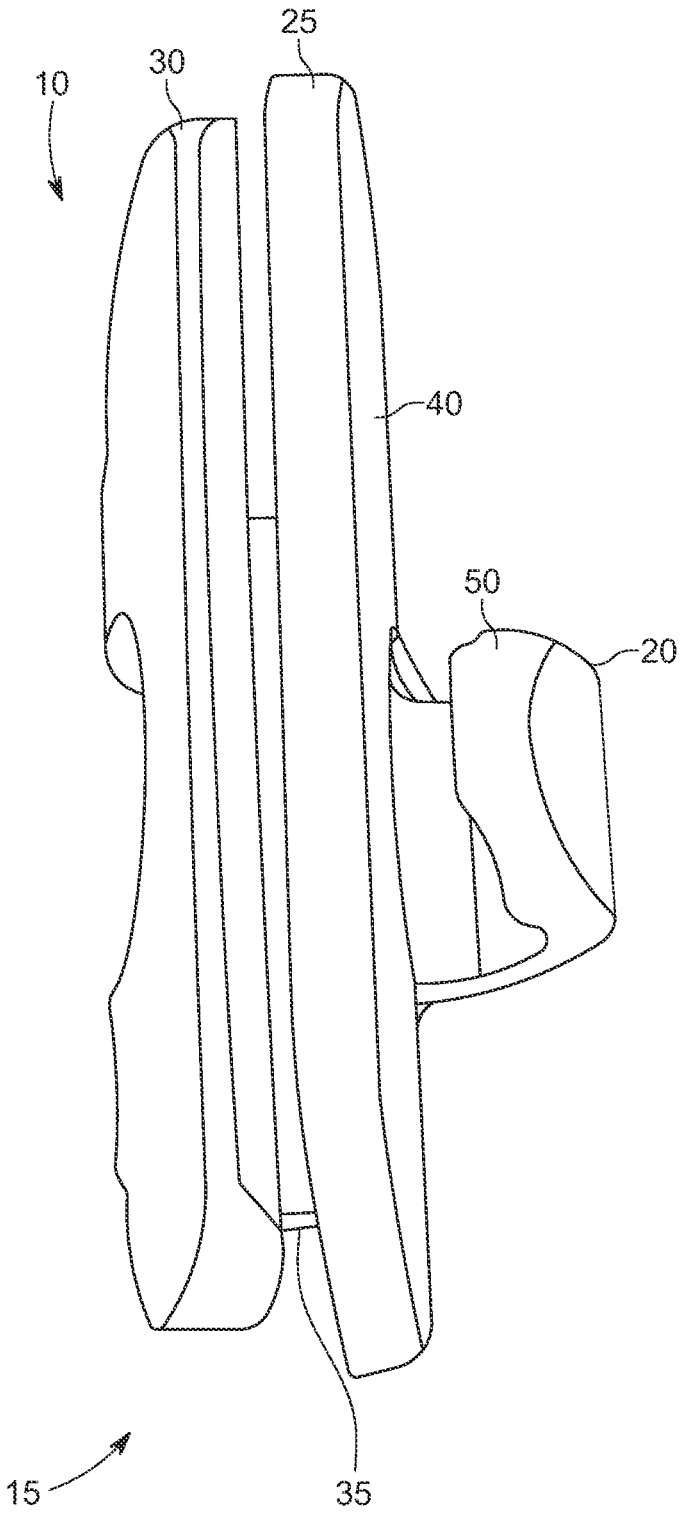
FIG. 3 is a top perspective view of the mask securing clip according to one embodiment of the present invention.

Embodiments of a mask securing clip for securement typically to the rim of the crown of a hat, such as a baseball cap, is described herein. Embodiments of the mask clip are typically fabricated a single unitary piece that includes a clamp or clamping portion and a hook portion. In some embodiments, the clamping portion is generally U-shaped and configured to clip over an edge of a hat's rim typically on the left and right sides of the hat to be securely held thereon. Depending on the particular style of hat, the rim to which the clip portion is attached can be a bottom edge of the crown, as well as, the edge of a visor or brim. The hook portion is typically formed on the outside surface of the U-shaped clamping portion. The hook is configured to receive a strap, such as the loop strap of a mask, therearound.

When a pair of mask securing clips are secured to both the right and left sides of a hat, a user wearing the hat can secure the left and right loops of a face mask to the respective hooks rather than around his/her ears potentially increasing the user's comfort. To adjust the position of the mask on the face as well as provide maximum comfort, a user can also slide the mask securing clamps forwardly and rearwardly as desired.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term "unitary" as used herein refers to an item or article that is formed as a single piece as opposed to an item fabricated from separate pieces that are subsequently joined together.

The term "hook" has used herein is broadly construed to include structures that can secure a strap to hinder free movement in at least one particular direction. For instance, the mask securing clips hinder a loop strap of a mask from freeing itself from the hook when a forward and/or downwardly force is applied to the strap, but the strap can be easily freed from the hook when moved upwardly. For instance as used herein, a button, similar to a squatchee of a baseball cap, attached to a clamping portion that secures a mask loop in place when a mask is being worn would also comprise a "hook".

The phrase "face mask" as used herein includes any type of protective covering designed to cover one or both of the nose and mouth that is held in place using straps. For instance, as used herein an N95-type respirator is a "face mask".

The term "hat" as used herein is to be broadly construed to include all types of hats, caps and headwear, including, but not limited to helmets and headbands.

An Embodiment of a Mask Securing Clip

FIGS. 1-4 illustrate embodiment of a unitary mask securing clip 10 (hereafter "mask clip") from several views. The mask clip is typically comprised of a plastic or polymeric material, such as polypropylene or polyamide, and can be formed by any suitable means although some variations are injected molded or 3D printed. The mask clip comprises a clamping portion 15 (also referred to as a "clip portion") and a hook portion 20.

Figure 4:
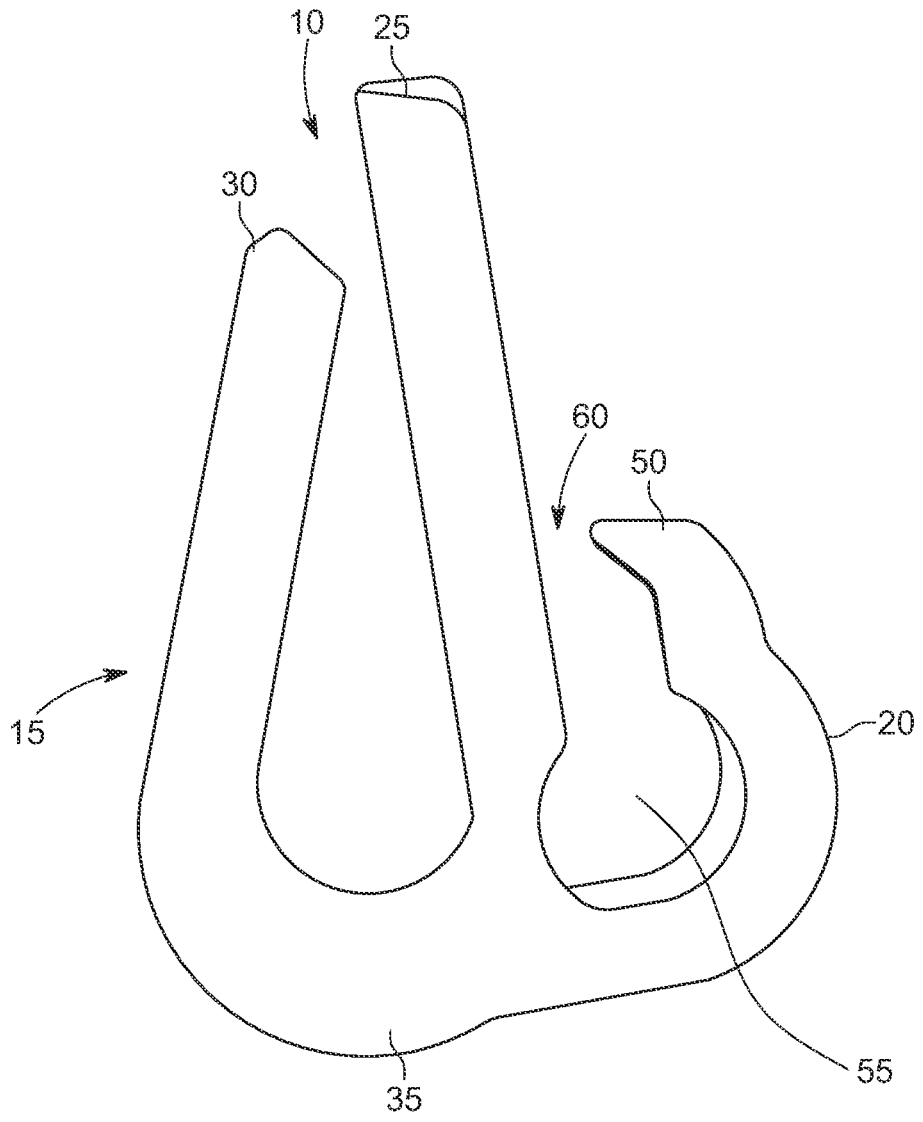
FIG. 4 is a side view of the mask securing clip according to one embodiment of the present invention.
Figure 5:
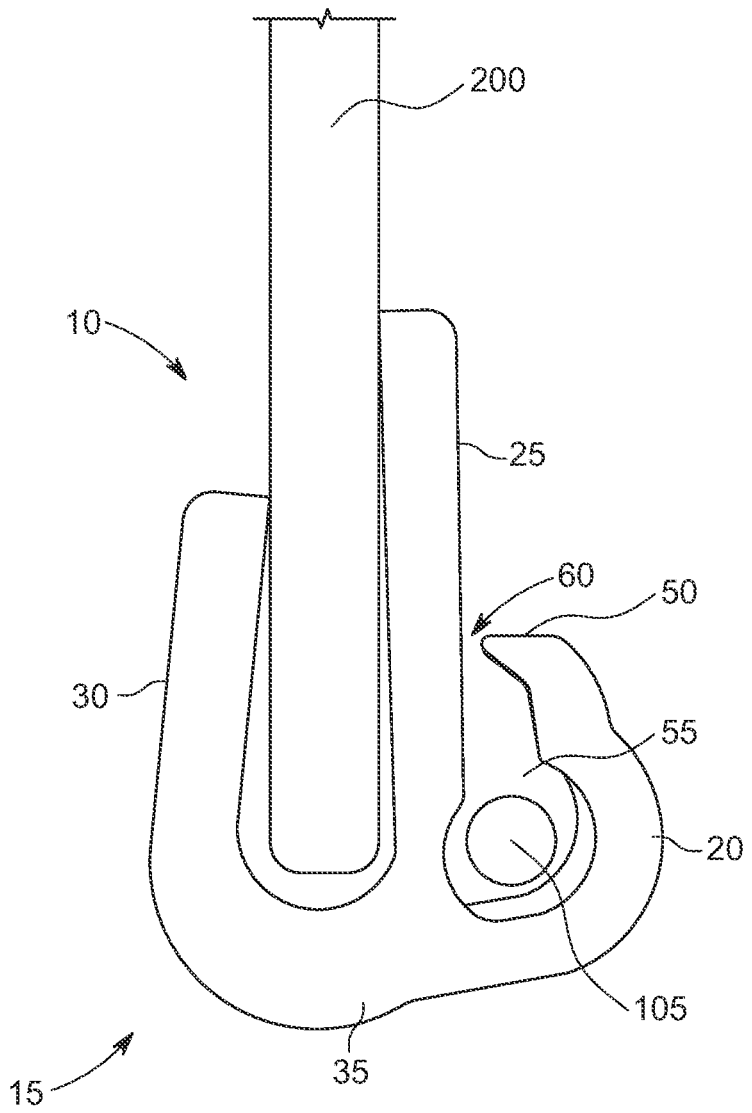
FIG. 5 is a representative cross sectional view of a mask securing clip clipped to a hat according to one embodiment of the present invention.

As can best shown FIGS. 4 & 5, the clamp portion 15 is generally U-shaped having opposing spaced upwardly-extending front and back sides 25 & 30 that are connected by a resilient base side 35 at their bottom ends. The upwardly-extending sides are tilted towards each such that the spacing between their respective top ends is typically less than the thickness of the rim of a ball cap or other style of hat or headband onto which the mask clips may be secured. When placed over the rim of a hat, the base side 35 elastically deforms and applies a biasing force against the rim through the upwardly-extending sides to secure the mask clip on the rim. The clamping force applied by the clamping portion is typically sufficient to prevent the mask clip from undesirably sliding along the rim as a result of pulling forces exerted on the mask clip by the straps of an associated mask, but also permit a user to slide the clip fore and aft along the rim to adjust the mask clip's position.

The dimensions and shape of the front and backs sides 25 & 30 can vary but as shown are generally rectangular in shape with rounded front and back ends. Sides that are circular, triangular, square or any other suitable shape are also contemplated. The dimensions of the sides can vary substantially as well but the front side 25 of the illustrated embodiment is about 1.5" long and 0.6" wide. The back side 30 is also about 1.5" long but slightly shorter than the front side with a width of about 0.45" wide.

The outer surface 40 of the front side is substantially flat providing an area on which indicia 45 can be imprinted, printed, molded, applied or otherwise provided thereon. The relatively low cost to produce a pair of mask clips combined with the area provided on the outer surface make the mask clip an ideal item for giveaway as part of a company's marketing plan.

The hook portion 20 extends outwardly from clamping portion 15. As shown, the hook portion extends from the base side 35 although in variations it can also extend from the front side 25. The hook portion as shown comprises an upwardly pointing hook, although the shape and figuration of the hook portion can vary substantially in variations and still perform its intended function of securing and holding a strap 105 of a mask 100 when the mask is being worn by a user.

The spacing forming an entrance throat 60 between the adjacent outer surface 40 of the front side and the tip 50 of the hook is typically similar in dimension or even slightly smaller than the diameter of a typical strap 105 it is configured to receive. A channel 55 is formed between the hook portion 20 and the clamping portion 15 in which the strap is received and held once inserted past the tip. The channel typically has a width or diameter greater than that of the typical strap. Functionally and as can be appreciated with reference to FIG. 5, the narrow spacing of the throat 60 acts to help hold the strap 105 in place on the mask clip 10 hindering the chance or risk that the strap will become unintentionally dislodged from the mask clip. However, because the straps on masks typically have some give and the hook portion itself has resiliency, the strap can be easily inserted into and pullout out of the channel with only a small amount of intentionally urging. In the illustrated embodiment, the distance between the tip and the outer surface is about 1.5-2.0 mm, and the diameter of the channel is about 4.0 mm which compares to a typical strap diameter of about 2.0 mm.

A Method of Using Mask Securing Clips

Figure 6:
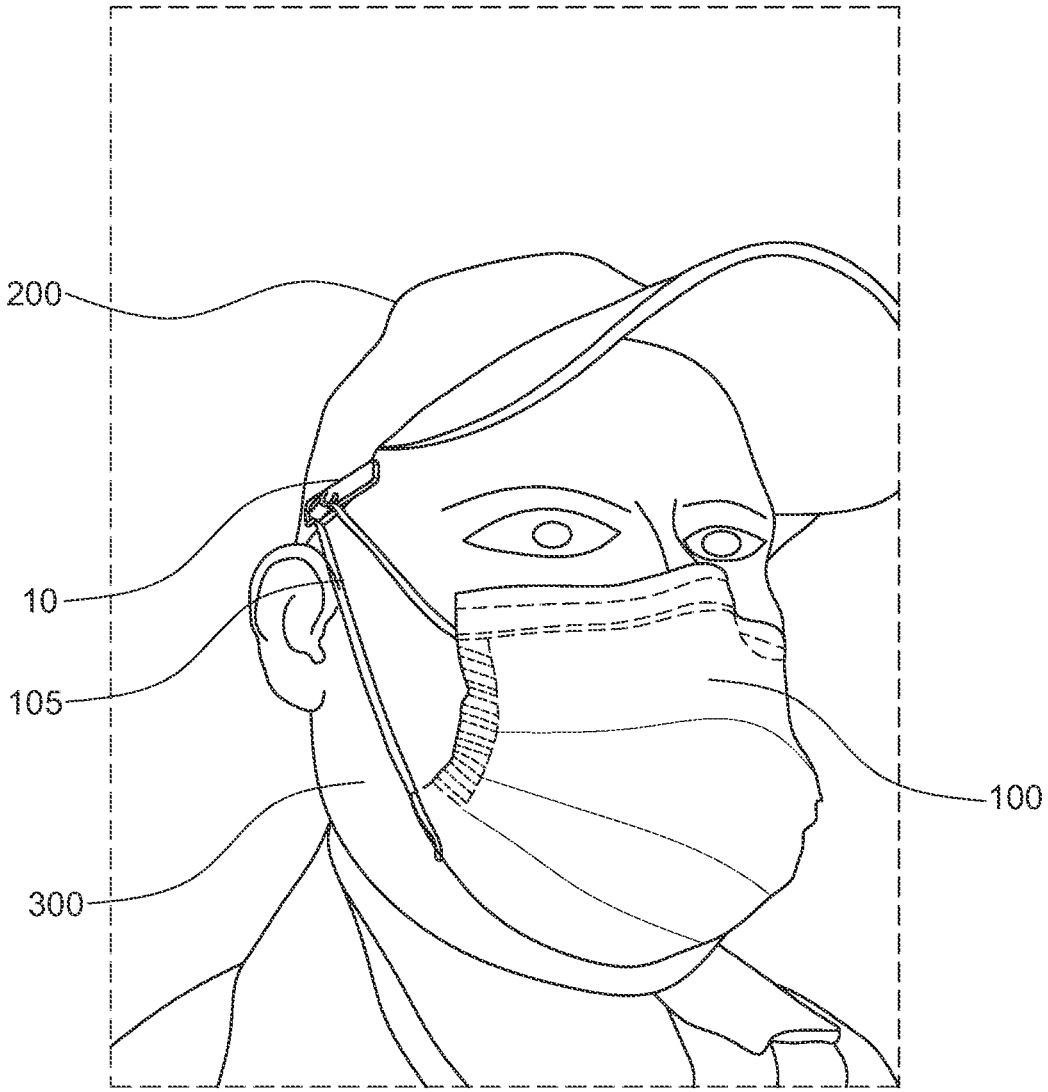
FIG. 6 is perspective view of a person wearing a face mask secured to a cap by way of a pair of mask securing clips according to one embodiment of the present invention.

FIG. 6 illustrates a mask 100 being worn by a person 300 wherein the mask clips 10 are secured to the bottom rim of a crown of a baseball-style cap 200 and the ear loop straps 105 of the mask are secured around the hook portions 20 on the mask clips. FIG. 5 shows a cross section of one of the straps received in the channel 55. As shown, the straps are not significantly impinging on the wearer's ears effectively eliminating a major point of discomfort experienced by many when wearing this style of mask.

Also of significance, the positioning of the mask clips 10 on a cap 200 acts to help firmly hold the bottom of the mask 100 against the underside of the wearer's chin helping to prevent the mask from riding up over time especially when the wearer 300 is talking. It is appreciated that the configuration of people's faces vary and that a mask when worn over the ears as intended might ride up on some people or fall off of the nose on others. Advantageously, embodiments of the mask clips can be moved forward or backwards along the rim to a position that best secures a particular mask to the wearer's face while offering an optimum level of comfort.

Figure 7:
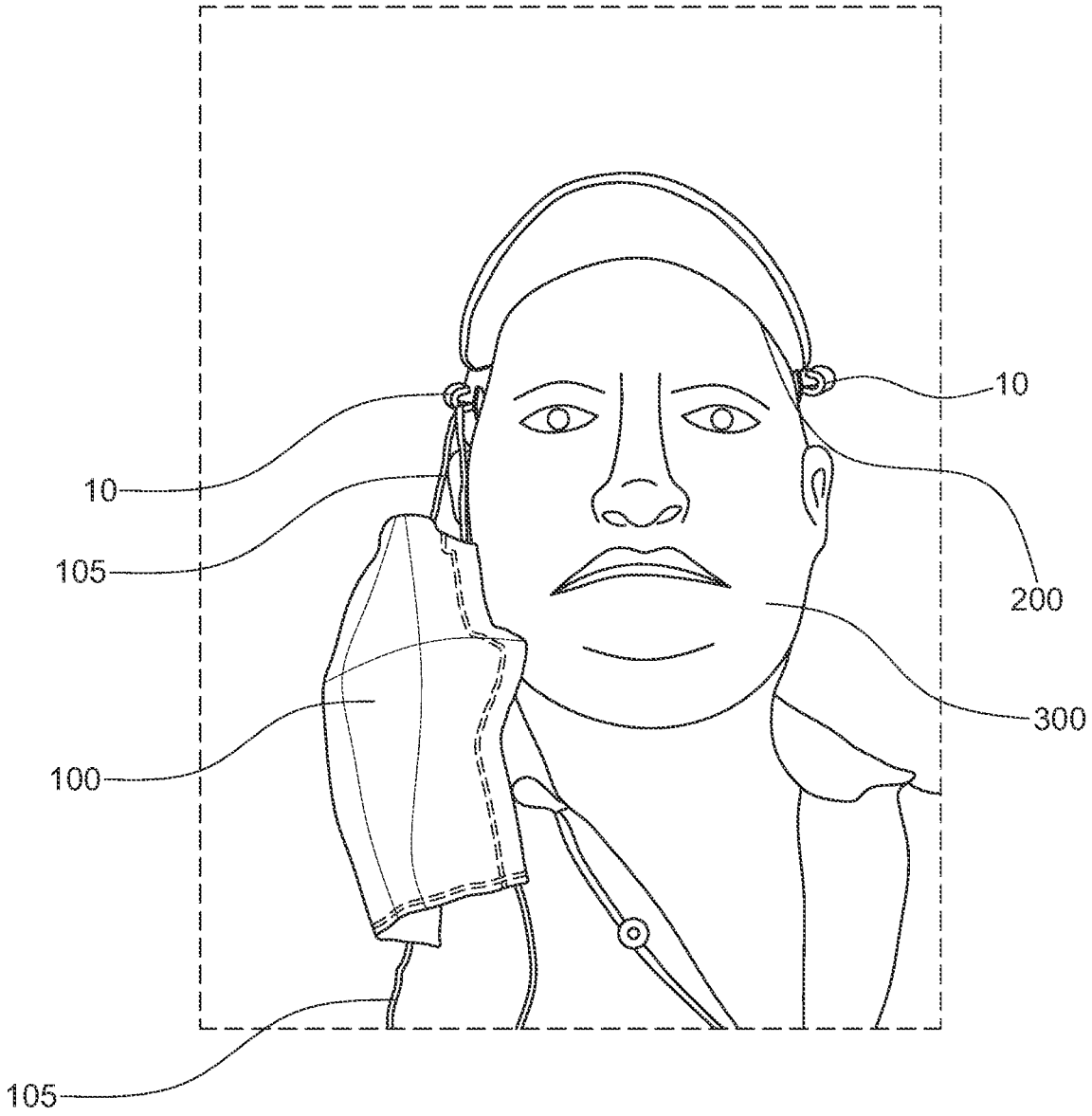
FIG. 7 is a perspective view of a person with the mask hanging from one clip attached to a cap according to one embodiment of the present invention.

FIG. 7 illustrates a person 300 wearing a baseball-style cap 200 with mask clips 10 attached to the rim of the cap with a mask 100 hanging from one mask clip by a single strap 105 to the side of the person's head. A wearer using the mask clips can easily release one strap of the mask from one mask clip to expose his/her mouth and nose as may be necessary when eating or as desired when leaving an indoor environment for an outdoor environment. Advantageously, the other strap remains securely attached to the other mask clip and hangs or dangles from the cap without risk of falling off as is often the case when a mask is left dangling from an ear. The wearer can easily reattach the unattached strap to re-mask without first having to retrieve the mask from a pocket or purse.

Use of the mask clips 10 typically comprises first installing a pair of mask clips on the left and right sides of a hat by way of the clamping portions 15. Most typically, the mask clips are installed on a rim of a hat's or cap's crown although in some instances, the mask clips can be installed on a brim or other parts of a hat as applicable.

Next, a user may slide one of the straps 105 of a mask 10 into a channel 55 of either mask clip. He or she may then put on the cap or hat thereafter positioning the mask over the mouth and nose and finally sliding the other strap into the other mask clip. Alternatively, the user may first put on the cap or hat and then secure the respective straps of the mask into the respective mask clips previously attached to the cap or hat.

Once the mask is attached to the mask clips and positioned over the user's mouth and nose, the user can as necessary slide one or both mask clips forwardly or rearwardly to adjust how the mask is positioned and held on the face. For instance a user who does not want the straps touching or otherwise interfering with sensitive ears may move the clips forward until the straps are fully positioned in front of the user's ears. Other users may need to move the clips one direction or another to adjust for the length of the looped straps.

As can be appreciated other adjustments can be made to facilitate a comfortable fit of a mask. For instance when the mask clips 10 are used in combination with a knit cap that has a rim that sits lower on the head, the user may find it necessary or desirable to make a knot in the looped straps to effectively shorten them.

The mask clips 10 are discussed herein pertaining to use with hats and caps. However, it is to be appreciated that variations of the mask clips can be used with other types of hats, headbands and even glasses.

A Second Embodiment of a Mask Securing Clip

Figure 8:
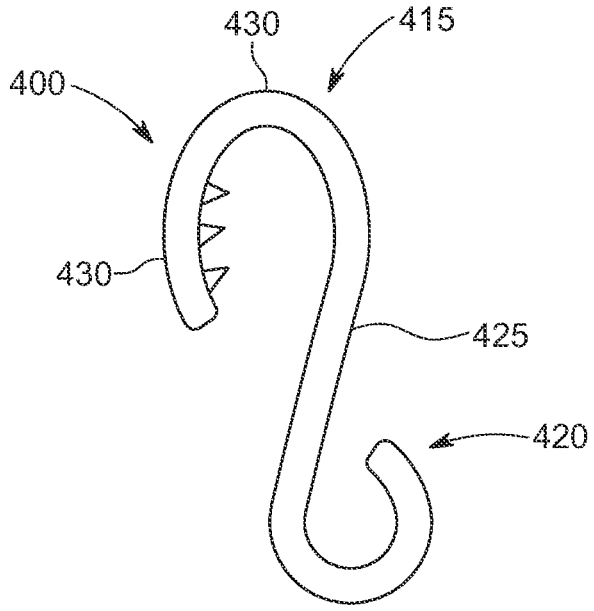
FIG. 8 is a side view of a mask securing clip according to another embodiment of the present invention.

FIG. 8 is a side view of a second embodiment of a mask securing clip 400. Like the first embodiment it is typically unitary and fabricated by similar means. The mask clip has a clamping portion 415 comprising front and back sides 425 & 430 that are joined by a base side 430 that also serves as a biasing mechanism. A hook section 420 into which a strap of a mask can be received is provided proximate a bottom end of the front side.

Unlike the first embodiment, the clamping portion 415 opens downwardly for clamping and/or hooking to an upwardly turned edge of a hat. For instance, some hardhats have a brim with an upwardly turned edge over which this type of clip can be secured.

A Third Embodiment of a Mask Securing Clip

Figure 9:
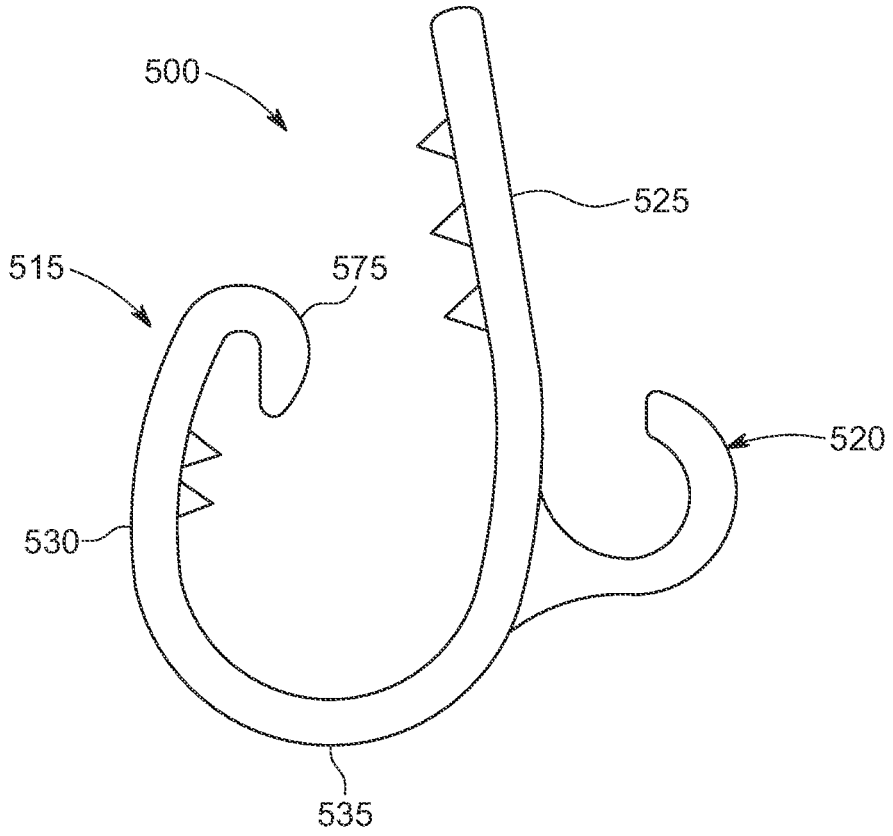
FIG. 9 is a side view of a mask securing clip according to yet another embodiment of the present invention.

FIG. 9 is a side view of a third embodiment of a mask securing clip 500. This embodiment is similar to the first embodiment with a hook portion 520 and a clamping portion 515 except the back side 530 of the clamping portion includes a downwardly hooked top edge 575. The clamping portion further includes a front side 525 joined to the back side by a bottom base 535 that also serves as a biasing mechanism.

This clip can be used similarly to the first embodiment except that as desired and as facilitated by a particular hat, the hooked upper edge 575 of the backside can be received over a hat's inner headband for addition securement to the piece of headwear.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, the embodiments is discussed above primarily comprise unitary mask clips wherein both the clamp portion and the hook portion comprise the same piece; however other embodiments are contemplated comprising separately manufactured components that are joined together in subsequent manufacturing steps or operations.

The clamping portion described herein essentially uses a biasing base side that is unitary with the sides of the clamping portion, but alterative embodiments are known wherein the sides are joined by a hinge and a biasing spring is provided to assert a clamping force. In other variations, the shape and configuration of the clamping portion can take on completely different form than described herein but still perform the same essential function of securing the mask clip to a hat or cap.

The shape of the hook portion can vary substantially from the hook illustrated herein. For instance, the hook could have a button shape with an annular channel configured to receive the strap. The hook portion could also comprise a hinged lever that can be selectively closed and opened to secure or release the strap therefrom.

We claim:

1. A combination comprising:

a hat; and a pair of mask clips, each mask clip of the pair of mask clips comprising (i) a clamping portion, the clamping portion including a front side and a back side spaced apart and joined together by a biasing base side, and (ii) a hook portion, the hook portion extending from the front side and being configured to receive and secure the strap;

wherein both mask clips are attached to a rim of the hat by way of the clamping portion of each mask clip of the pair of mask clips.

2. The combination of claim 1, further comprising the face mask with first and second straps, the first strap being received in the hook portion of one mask clip of the pair of mask clips and the second strap being received in the hook portion of the other mask clip of the pair of mask clips.

3. A mask clip for securing to a hat and holding a strap of a face mask therein, the mask clip comprising:

a clamping portion, the clamping portion including a front side and a back side spaced apart and joined together by a biasing base side; and a hook portion, the hook portion extending from the front side and being configured to receive and secure the strap;

wherein a top edge of the hook portion is spaced from the front side forming a throat through which the strap can be inserted into a channel formed between the hook portion and the front side, wherein the channel has a width significantly greater than the spacing of the throat; and wherein both mask clips are attached to a rim of the hat by way of the clamping portion of each mask clip of the pair of mask clips.

4. The combination of claim 3, further comprising the face mask with first and second straps, the first strap being received in the hook portion of one mask clip of the pair of mask clips and the second strap being received in the hook portion of the other mask clip of the pair of mask clips.

5. A method of using a pair of mask clips with a hat and a face mask, the method comprising:

providing the hat, the mask and the pair of mask clips, each mask clip of the pair of mask clips comprising (i)

a clamping portion, the clamping portion including a front side and a back side spaced apart and joined together by a biasing base side, and (ii) a hook portion, the hook portion extending from the front side and being configured to receive and secure the strap;

securing the clamping portion of a first mask clip of the pair of mask clips to a rim of the hat on a left side of the hat;

securing the clamping portion of a second mask clip of the pair of mask clips to the rim of the hat on a right side of the hat;

donning the hat by a person;

clipping a first strap of the face mask into the hook portion of the first mask clip;

clipping a second strap of the face mask into the hook portion of the second mask clip; and positioning the face mask over a face of the person.

6. The method of claim 5, unclipping one of the first and second straps from the respective first and second mask clips and permitting the mask to dangle from the other of the first and second straps to the side of the face.

7. The method of claim 5, further comprising sliding one of the left and right mask clips forwardly or rearwardly along the rim to adjust a position thereof.

* * * * *